US010537192B2

(12) United States Patent
Fastermann et al.

(10) Patent No.: US 10,537,192 B2
(45) Date of Patent: Jan. 21, 2020

(54) FASTENING DEVICE HAVING A POSITIONABLE CARRYING ELEMENT

(71) Applicant: TESA SE, Norderstedt (DE)

(72) Inventors: Franz Fastermann, Elmshorn (DE); Martje Masson, Hamburg (DE); Walter Heidenfels, Hamburg (DE)

(73) Assignee: tesa SE, Norderstedt (DE)

( * ) Notice: Subject to any disclaimer, the term of this patent is extended or adjusted under 35 U.S.C. 154(b) by 0 days.

(21) Appl. No.: 15/754,131

(22) PCT Filed: Aug. 10, 2016

(86) PCT No.: PCT/EP2016/069000
§ 371 (c)(1),
(2) Date: Feb. 21, 2018

(87) PCT Pub. No.: WO2017/032597
PCT Pub. Date: Mar. 2, 2017

(65) Prior Publication Data

US 2018/0289179 A1 Oct. 11, 2018

(30) Foreign Application Priority Data

Aug. 21, 2015 (DE) ..... 10 2015 215 970

(51) Int. Cl.
*A47G 1/00* (2006.01)
*A47G 1/20* (2006.01)
(Continued)

(52) U.S. Cl.
CPC ..... *A47G 1/202* (2013.01); *A47G 1/175* (2013.01); *A47G 29/00* (2013.01)

(58) Field of Classification Search
CPC ..... A47G 1/17; A47G 1/1606; A47G 1/1613; A47G 1/164; A47G 1/175
(Continued)

(56) References Cited

U.S. PATENT DOCUMENTS 6,663,075 B2 12/2003 Zuller
8,356,777 B2 1/2013 Miles et al.
(Continued)

FOREIGN PATENT DOCUMENTS

CN 101 623 168 A 1/2010
WO 92 11333 A1 7/1992
WO 2012 087163 A1 6/2012

*Primary Examiner* — Steven M Marsh
(74) *Attorney, Agent, or Firm* — Norris McLaughlin, P.A.

(57) ABSTRACT

The invention relates to a fastening device having at least one positionable holding device, comprising a base plate having an extensively flat rear surface and a front surface, opposite the rear surface, wherein a first guide channel is formed on the front surface. The guide channel is delimited by side walls, wherein engagement areas are formed at least in sections on at least one of the side walls. According to the invention, a slide element is arranged in the guide channel, which can be displaced along the guide channel, wherein the slide element has a carrying element, wherein two spring elements are formed on the slide element, which can engage with the engagement surfaces of the guide channel in a blocking position, and wherein there is a movable locking element on the slide element, which fastens the spring elements at least in the blocking position.

15 Claims, 10 Drawing Sheets

(51) Int. Cl.
*A47G 1/17* (2006.01)
*A47G 29/00* (2006.01)

(58) Field of Classification Search
USPC ..... 248/466, 467, 475.1, 477, 478
See application file for complete search history.

(56) References Cited

U.S. PATENT DOCUMENTS

| | | | | |
|---|---|---|---|---|
| 8,702,051 | B2 * | 4/2014 | Vanham | F16B 5/0692 248/477 |
| 8,899,541 | B2 * | 12/2014 | Bixler | A47G 1/164 248/295.11 |
| 10,278,524 | B2 * | 5/2019 | Greve | A47G 1/164 |
| 2003/0029986 | A1 | 2/2003 | Zuller | |
| 2007/0187566 | A1 * | 8/2007 | Price | A47G 1/1613 248/477 |

* cited by examiner

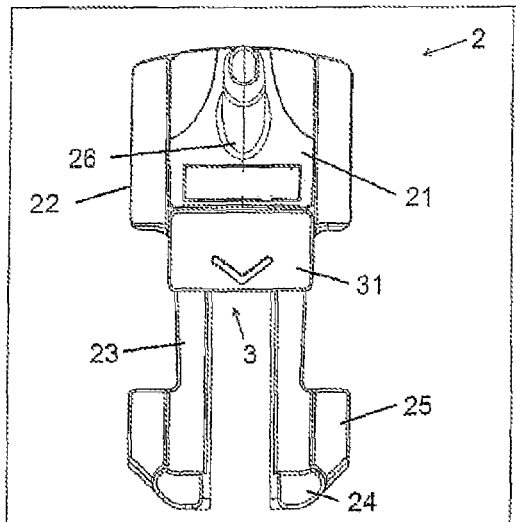
Fig. 13
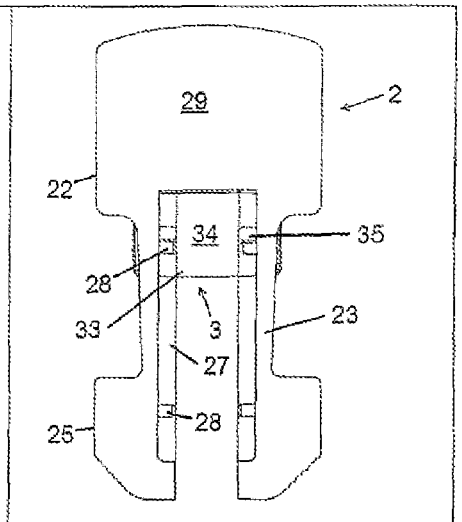
Fig. 14
Fig. 15
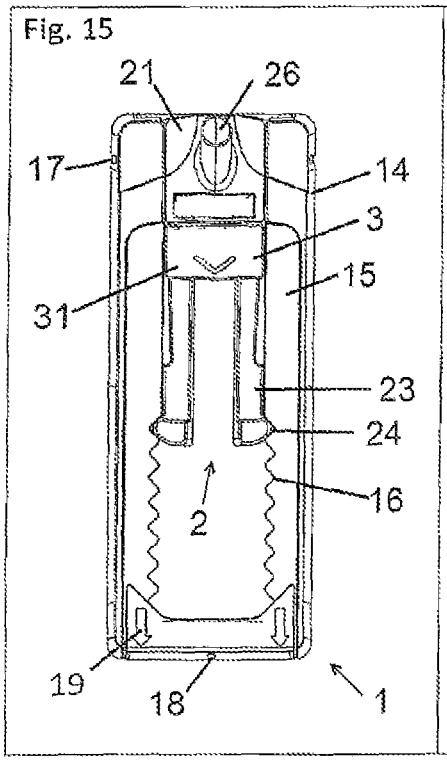
Fig. 16
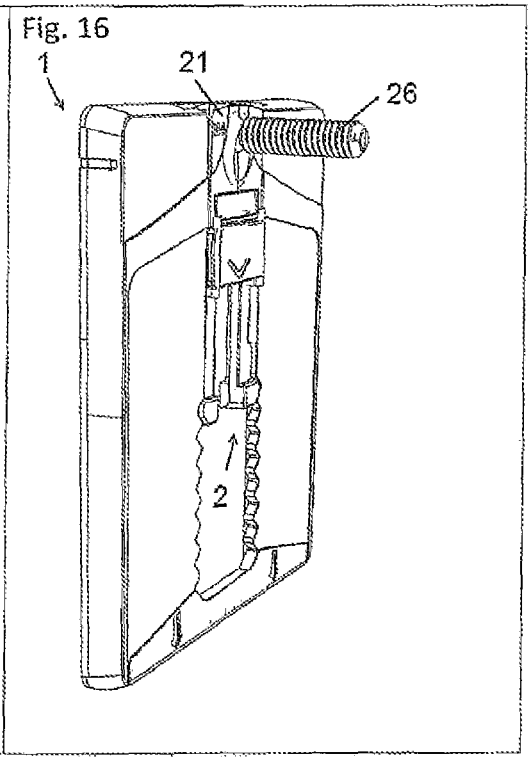

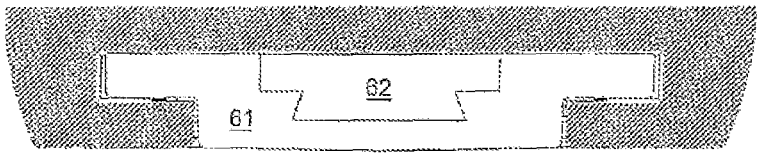
Fig. 22 Section C-C
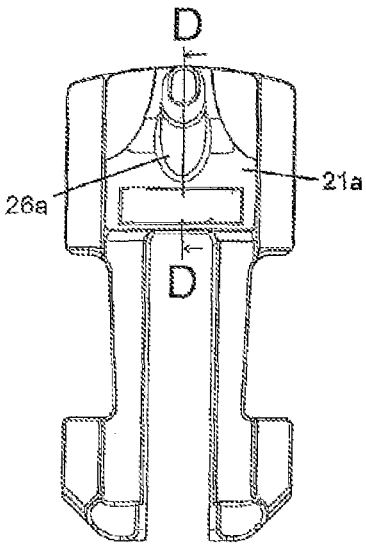
Fig. 23 Section D-D
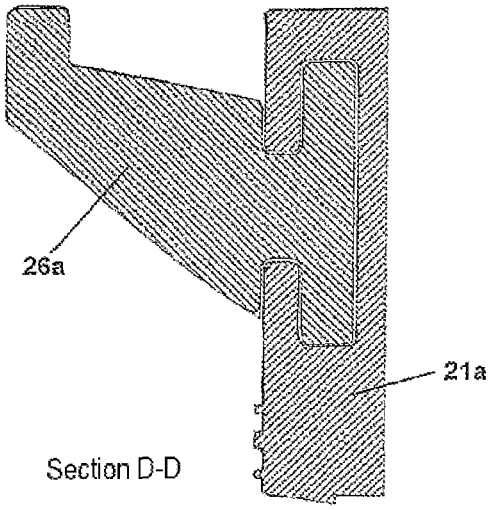
Fig. 24

FASTENING DEVICE HAVING A POSITIONABLE CARRYING ELEMENT

This application is a 371 of PCT/EP2016/069000, filed Aug. 10, 2016, which claims foreign priority benefit under 35 U.S.C. § 119 of the German Patent Application No. 10 2015 215 970.1, filed Aug. 21, 2015, the disclosures of which are incorporated herein by reference.

The present invention relates to a fastening device having at least one positionable carrying element according to the preamble of claim 1.

Bondable retaining bodies, such as, for example, self-adhesive hooks, are known in general and are used in a versatile manner for suspending decorative and functional household articles. Once bonded, said simple retaining bodies are not vertically adjustable without undoing the adhesion. Suspending a picture frame with several suspension points can be difficult in particular when it is to be oriented in a precise horizontal manner. Attaching several pictures which are to be oriented with reference to a reference height is also a challenge using the known simple retaining bodies.

Vertically adjustable fastening systems for attachment to a wall are already known from the prior art. Thus, U.S. Pat. No. 6,663,075 B2 discloses a vertically adjustable system with a vertical guide channel, the guide channel being flanked by toothings, the design of which evokes the battlements of a castle. Engagement elements, which are displaceable horizontally and in each case in the opposite direction and are both arranged on a frame which is held displaceably in the guide channel, engage in the toothings from the inside. The engagement elements are pressed into the toothing as an option by spring elements. The frame of said device is provided with a suspending means for receiving an object which can be suspended thereon. The disadvantage of such a structure, however, is that the frame of said device sags under load and consequently causes the engagement elements to tilt. As a result, the engagement elements, which are held at best by the spring tension, no longer engage reliably in the toothing and the load moves downward, following gravity.

WO 2012/087163 A1 discloses a vertically adjustable retaining device having a toothed guide channel in which a carrying element is displaceable with a pair of oppositely situated spring arms. The spring arms are pre-tensioned outward and the outer surfaces thereof engage in the toothing of the guide channel. If the spring arms are pressed inward, the carrying element can be displaced. The load is introduced via the upper end face of the carrying element. A disadvantage of such a solution, however, is that as a result of an asymmetrical surface load, a moment acts on the spring arms and the retaining device such that the spring arms can be loaded on one side and then slip out of the toothing. Only the spring force of the spring arms can counter this. When said springs apply correspondingly high spring forces in order to prevent slipping, it is only possible to bend the spring arms inward in order to displace the carrying element with increased expenditure of force.

U.S. Pat. No. 8,356,777 B2 discloses multiple realizations of height-adjustable retaining devices which utilize the principle of cable ties with spring tongues or pawl locks which are self-sealing in the direction of the earth gravitation field. The disadvantage here is that forces which act on the object against the force of gravity are not absorbed by the retaining device and the retaining device can thus move upward unintentionally, for example when a person accidentally knocks against the object.

CN 101623168 A discloses a fastening device having a sliding element, which is displaceable in a guide channel and on which a carrying element is realized. Spring elements, which can engage with engagement surfaces realized on the guide channel in a blocking position, are realized on the sliding element.

It is the object of the present invention to provide a fastening device, by means of which an object is able to be suspended on a wall and the height position of which is able to be repeatedly adjusted and then secured against arbitrarily acting forces.

The object is achieved by a fastening device with the features of claim 1. A displaceability, and consequently a possibility to position the carrying element, is ensured by a sliding element with spring arms. The blocking element restricts deformation of the spring arms such that the spring arms are no longer able to deform sufficiently in order to slip out of the engagement surfaces on the first guide channel of the sliding element, and they consequently fix the position of the sliding element in a reliable manner. A blocking position is to be understood in this context as a position of the blocking element in which the spring elements engage the engagement surfaces of the guide channel and the sliding element being displaced relative to the basic body is impossible without destroying the device.

Advantageous further developments and improvements of the fastening device specified in the independent claim are possible as a result of the measures mentioned in the dependent claims.

According to an advantageous embodiment, it is provided that, with the blocking element in a release position, the spring elements are not in engagement with the engagement surfaces, the blocking element also fixing the spring elements in the release position. As a result, the spring elements are moved out of engagement with the engagement surfaces of the guide channel such that a largely force-free displacement of the sliding element relative to the basic body is made possible. Consequently, a user inadvertently confusing the blocking position with the release position can be avoided as in the release position no latching-in of the sliding body takes place.

According to an advantageous embodiment, it is provided that the two spring elements realize a second guide channel, wherein the blocking element is reversibly displaceable along the second guide channel. The blocking element can be displaced simply through a second guide channel and consequently reliably retained on the sliding element. It is particularly advantageous, in this case, when the blocking element in a first release position in the second guide channel enables a displacement of the sliding element along the first guide channel and the blocking element in a second blocking position in the second guide channel suppresses a displacement of the sliding element along the first guide channel. A displaceable blocking element which is displaceable between a release position and a blocking position is a simple option which is easy to control in order to release or lock the spring elements. It is particularly advantageous, in this case, when said displacement is reversible such that repeated locking or releasing after locking is possible in order to enable, for example, re-adjustment.

In a preferred manner, release is effected as a result of displacement of the blocking element from the second blocking position into the first release position against the force of gravity. Consequently, inadvertent unlocking can be prevented as the force of gravity of an object suspended on the carrying element urges the blocking element into the second blocking position.

According to a further advantageous development, it is provided that the second guide channel runs completely inside the first guide channel. As a result, a particularly compact and easy method of construction is achieved. As, in the case of an adhesive fastening device, the useful load is reduced by the dead weight of the retaining device, it is advantageous when the retaining device can be realized in a particularly easy manner in order to increase a useful load capacity for the fastening device.

According to an advantageous embodiment, it is provided that the first guide channel is closed by a connecting web at one end, in a preferred manner at the lower end in the direction of the gravity. A connecting web ensures that the sliding element does not slip out of the first guide channel in the base plate and consequently fall down.

A further advantageous embodiment comprises guide grooves and latching elements on the sliding element which serve for guiding and locking for the blocking element. Consequently, the blocking element is guided for displacement and can be locked in the respective end positions, i.e. in the first release position and in the second blocking position, in order to prevent inadvertent displacement of the blocking element.

According to a further advantageous realization, it is provided that the sliding element comprises a carrying plate with a groove which runs perpendicular to the first guide channel, wherein the carrying element is displaceably mounted in the horizontally extending groove. As a result, along with vertical adjustment, a horizontal adjustment option is additionally created, for example, in order, in the case of a picture frame with multiple suspension points, to be able to make fine adjustments to the distance between the suspension points once the fastening device has fixed on the wall.

In addition, it is advantageously provided that on the free ends of the spring elements, the sliding element comprises two engagement surfaces which can be operatively connected to the first engagement surfaces. The sliding element can be latched and fixed in a sturdy manner in the base plate as a result.

According to a further advantageous embodiment, it is provided that guide strips, by way of which the sliding element is guided displaceably in the first guide channel of the base, are realized on the spring elements. As a result, the risk of the sliding element tilting or catching can be reduced, as a result of which a convenient and easy displacement of the sliding element is possible. In addition, the front walls can act here as protection in order to prevent, in a reliable manner, the sliding element falling out of the first guide channel.

In addition, it is advantageously provided that pressing surfaces are provided on the base plate for applying an installing force when bonding the base plate to a surface. In order to enable secure bonding of the fastening device on a surface, the fastening device has to be pressed against the surface at a corresponding pressure. As the force applied, in dependence on the person who intends to bond the fastening device to the wall, is largely constant, the effective pressing can be increased as a result of the force being applied repeatedly to different pressing surfaces. Consequently, a better adhesion result, and linked thereto a more reliable hold of the fastening device on the wall, is able to be achieved.

According to a preferred exemplary embodiment, the fastening device includes adhesive means for fixing on a surface. Particularly advantageous, in this case, is an adhesive strip which is effective on two sides and which can be included either separately or already bonded with the rear surface of the base plate in the fastening device. The fastening device is consequently able to be fixed on the surface in a simple and easy manner. It is particularly advantageous, in this case, when the adhesive means, in particular the adhesive strip which is effective on two side, are detachable from the surface in a residue-free and damage-free manner. Such adhesion can be effected, for example, using adhesive strips which can be pulled undone.

The invention is explained below by way of preferred embodiments with reference to the accompanying figures, in which:

FIG. 13 shows the front view of the sliding element with the blocking element inserted;

FIG. 14 shows the rear view of the sliding element with the blocking element inserted;

FIG. 15 shows the front view of a retaining device of the fastening device according to the invention;

FIG. 16 shows a perspective view of a further realization of a retaining device;

FIG. 22 shows a further sectional diagram to illustrate the guide channels;

FIG. 23 shows a sectional diagram of a further realization of the sliding element with a carrying element which is additionally horizontally adjustable;

FIG. 24 shows a further sectional diagram of the sliding element with the carrying element which is additionally horizontally adjustable.

It is assumed below that a fastening device 100 according to the invention is attached to a vertical wall of a living area.

Directional specifications such as above and below refer to said case. In addition, identical components or components with the identical function are provided with identical reference signs in the following description of the figures.

Figure 1:
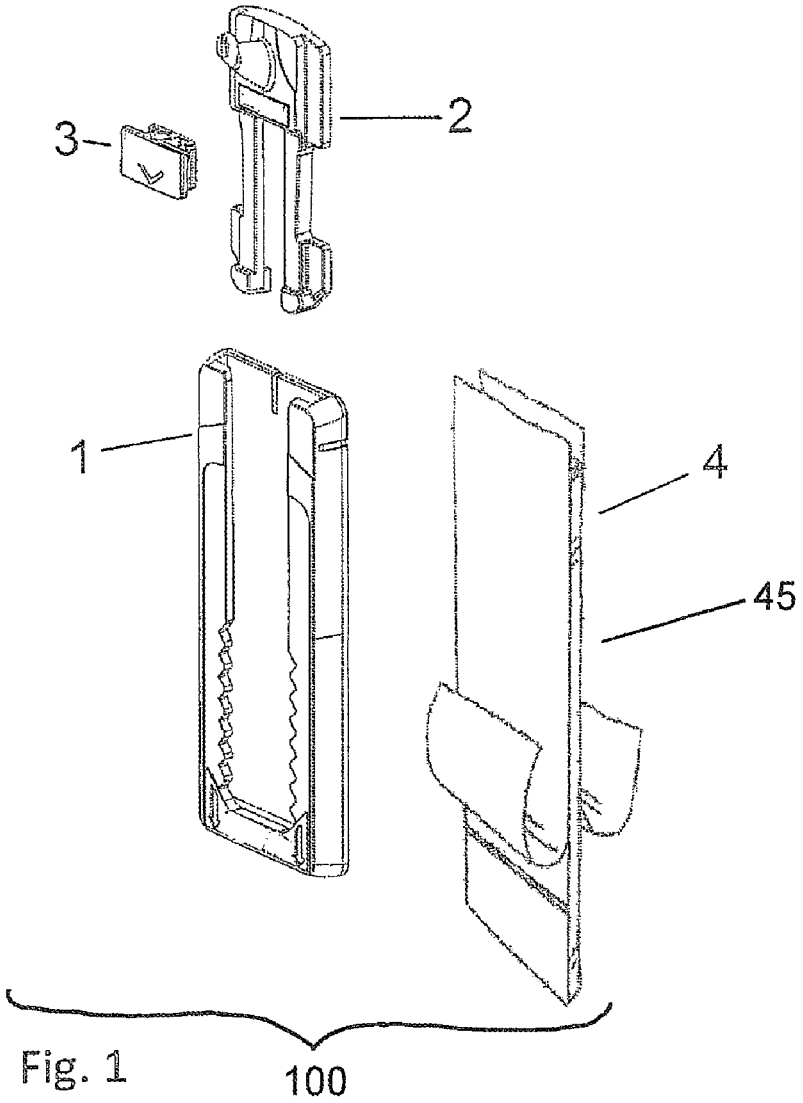
FIG. 1 shows a perspective view of a fastening device according to the invention.

FIG. 1 shows a fastening device 100 according to the invention which includes a base plate 1, a sliding element 2 and a blocking element 3. In addition, the fastening device 100 according to the invention can include fastening means 4, in particular an adhesive strip 45 which is effective on two sides, for attaching the fastening device 100 on a wall. A retaining device 10 comprises at least one base plate 1 and one sliding element 2 which is displaceable relative thereto.

Figure 2:
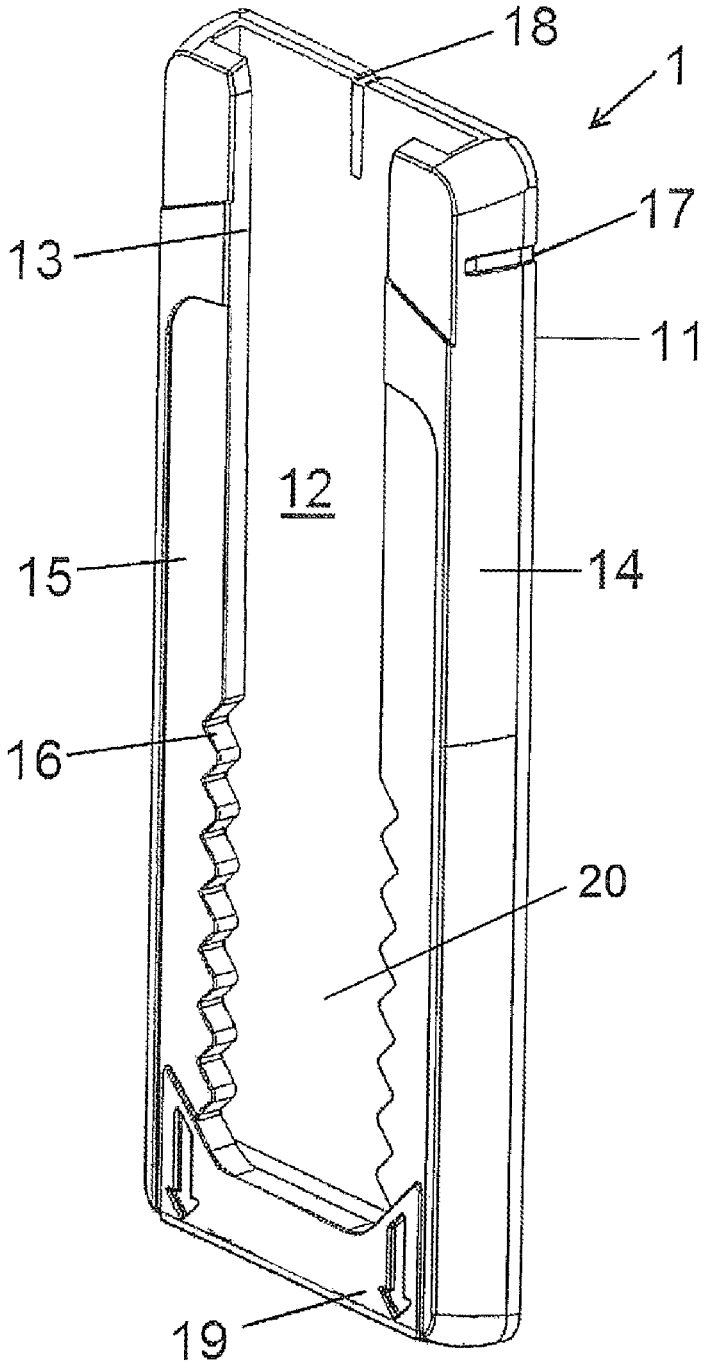
FIG. 2 shows a perspective view of a base plate of the fastening device according to the invention.
Figure 3:
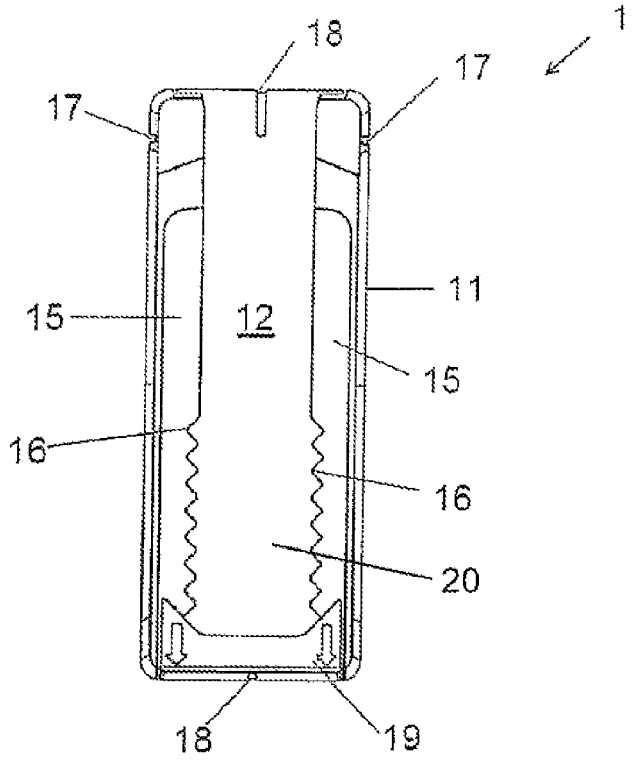
FIG. 3 shows the front view of the base plate from FIG. 2.
Figure 4:
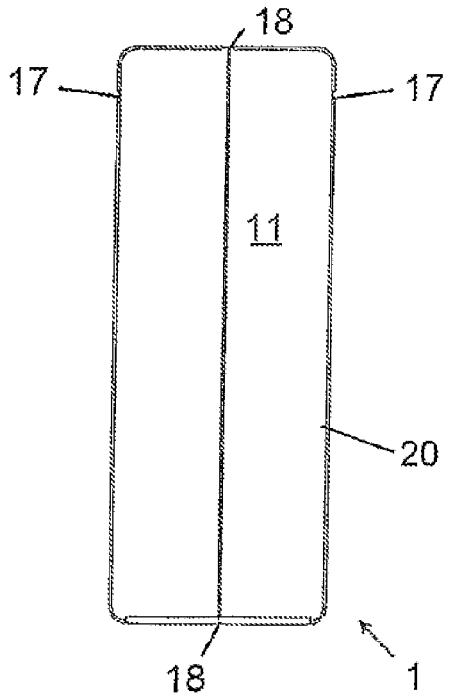
FIG. 4 shows the rear view of the base plate from FIG. 2.
Figure 5:
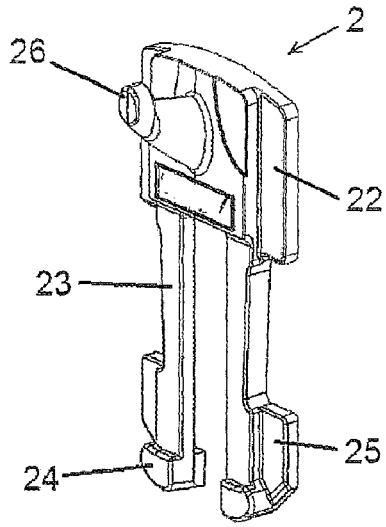
FIG. 5 shows a perspective view of a sliding element of a fastening device according to the invention.
Figure 6:
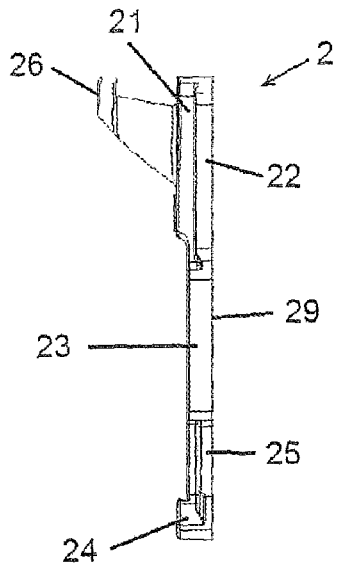
FIG. 6 shows a side view of the sliding element from FIG. 5.
Figure 7:
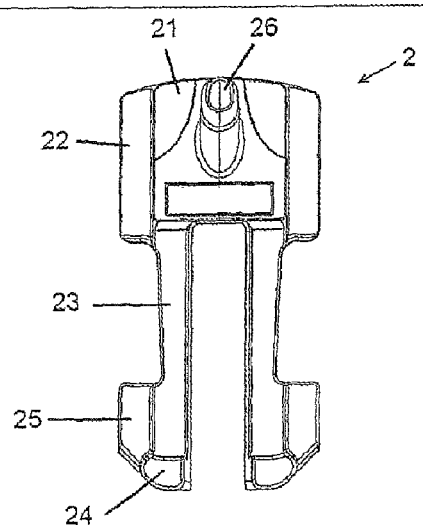
FIG. 7 shows the front view of the sliding element from FIG. 5.
Figure 8:
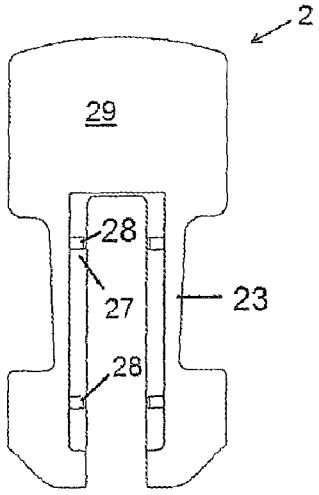
FIG. 8 shows the rear view of the sliding element from FIG. 5.
Figure 9:
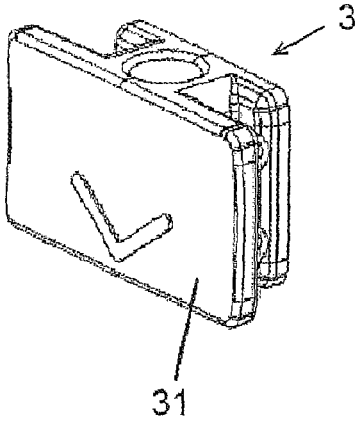
FIG. 9 shows a perspective view onto the front surface of a blocking element of a fastening device according to the invention.
Figure 10:
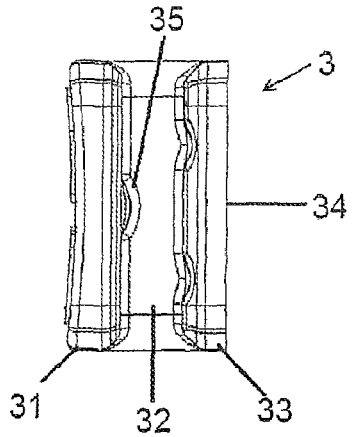
FIG. 10 shows a side view of the blocking element from FIG. 9.
Figure 11:
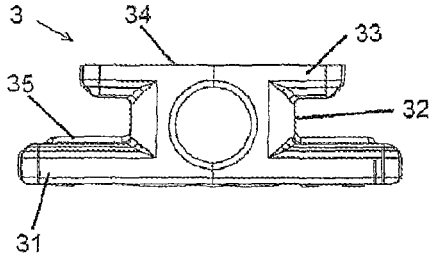
FIG. 11 shows the top view of the blocking element from FIG. 9.
Figure 12:
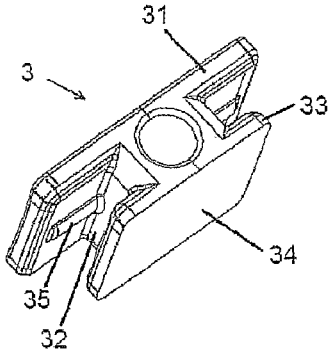
FIG. 12 shows a further perspective view onto the rear surface of the blocking element from FIG. 9.

As shown in FIG. 2 to FIG. 4, the base plate 1 comprises a fastening device 100 according to the invention, a base 20 with a substantially flat rear surface 11 which, in the installed state, extends in a plane-parallel manner to the wall on which it is to be fastened. The base 20 additionally comprises a front surface 12 which is located opposite the rear surface 11 and from which two side walls 14, which run in parallel, extend in the vertical direction parallel to its side edges. In this case, the inside surfaces 13 of the side walls 14 run substantially normal to the front surface 12 of the base 20. A vent opening can be realized on the rear surface 11 of the base plate 1.

Connecting to the side walls 13, in each case realized at a right angle thereto, are front walls 15 which extend at a distance parallel to the front surface 12 of the base 20. The front walls 15 comprise end faces 13 which face one another, are spaced from one another and, together with the front surface 12 of the base 20, realize a first guide channel 61. The oppositely situated end faces 13 are smooth in portions and realized as first engagement surfaces 16 in portions. The first engagement surfaces 16 can be realized as symmetrical or asymmetrical toothing. The flank tips and the bottom of the toothing of the engagement surfaces 16 are preferably rounded.

As an alternative to this or in addition to it, it is possible to provide the engagement surfaces 16 with a surface which, compared to the second engagement surfaces 24 which are realized on the sliding element 2 and are described below in the description relating to FIG. 5 to FIG. 8, comprises a static friction coefficient of at least 0.2 measured to DIN 53375.

The front walls 15 can close off in the lower region with a horizontal connecting web 19 which provides a further boundary of the first guide channel 61 and connects the two front walls 15 together in said region. The connecting web 19 can carry operating instructions or a brand logo as a source of information.

For improved vertical positioning of the retaining device 10 or of the base plate 1, lateral positioning notches 17, which can be aligned to a horizontal reference line, can be provided on the outsides of the two side walls 14. In an analogous manner to this, positioning notches 18, which in each case are oppositely situated centrally on a horizontal upper edge and/or on a horizontal lower edge on the retaining device 10 or on the base plate 1, can be realized for determining a horizontal position. In cooperation with a spirit level or a plumb line, the oppositely situated positioning notches 18 additionally support a precise vertical alignment of the base plate 1 or the retaining device 10. As an alternative to this, a spirit level integrated in the base plate 1 or miniaturized electro-mechanical tilt sensors with a wireless display or a display that is connectable through wires can simplify the installation.

The front walls 15 with the front surface 12 of the base 20, the insides of the side walls 14, the inside of the front walls 15 and the end faces 13 of the front walls 15 realize the first guide channel 61 which runs vertically and comprises a T-shaped cross section.

FIG. 5 to FIG. 8 show a sliding element 2 of a fastening device 100 according to the invention. The sliding element 2 includes a carrying plate 21 with an upper edge, a flat rear surface 29, a lower edge and a front surface. A carrying element 26 for attaching objects rises from the front surface of the carrying plate 21. The carrying element 26, in this case, is preferably formed as a sloping truncated cone with an elliptical or oval base. The carrying plate 21 is flanked to the side by a pair of first guide strips 22. The rear surfaces of the two guide strips 22 are coplanar to the rear surface 29 of the carrying plate 21.

Two web-shaped spring elements 23, which extend parallel in the vertical direction, extend from a lower end face of the carrying plate 21. A rear surface of the spring elements 23 is coplanar to the rear surface 29 of the carrying plate 21. The spring elements 23 each carry, on their rear side, guide grooves 27 which face one another for guiding the blocking element 3, which is described in more detail below in the description of the figures relating to FIG. 9 to FIG. 12. Latching elements 28, which rise from the bottom of the guide groove 27, are arranged in the guide grooves 27 of the spring elements 23. The lower region of the spring elements 23, remote from the carrying element 26, is flanked by second guide strips 25. Said second guide strips 25 are remote from one another and point outward. The side edges of the second guide strips 25 are co-linear with the side edges of the first guide strips 22. The spring elements 23 can comprise recesses in order to increase the elasticity of the spring element 23 and to facilitate deflecting when the sliding element 2 is displaced.

The two spring elements 23 form a second guide channel 62, the blocking element 3 being reversibly displaceable along said second guide channel 62. Second engagement elements 24, which act outward in each case, are integrally formed on the free ends of the spring elements 23. A straight line, which is perpendicular to the rear surface 29 of the carrying plate 21, lies in the tangential plane of each of the second engagement surfaces 24. The second engagement surfaces 24 are realized for a positive locking, friction locking or a combined positive and friction locking engagement complementarily to the first engagement surfaces 16 of the base plate 1.

Along with a connection to a lower end face of the carrying plate 21, each spring element 23 can be connected to the first guide strips 22. This reinforces a connection between the spring elements 23 and the carrying plate 21 and, in the case of suitably realized web profiles of the spring elements 23, provides the spring elements 23 with a remaining degree of freedom about an axis which is perpendicular to the rear surface 29 of the carrying plate 21. The spring elements 23, in particular the second engagement surfaces 24 realized on the spring elements 23, are consequently moved substantially in a plane parallel to the rear surface 29 of the carrying plate 21.

As shown in a further multi-part embodiment of a sliding element 2 in FIG. 23 and FIG. 24, a guide profile, which is displaceable to the side in a horizontally extending guide rail of the carrying plate 21, **21*a*, can be integrally formed on the carrying element 26, 26*a*. Consequently, it is not only possible to adapt the position of the carrying element 26 in a vertical manner, but a horizontal adjustment option is also made possible for the carrying element 26. Interacting latching elements on the guide profile of the carrying element 26, 26*a*** and on the guide rail of the carrying plate 21, 21*a* can define multiple latching positions of the carrying element 26*a*. A central starting position, which can then be corrected to the left or to the right as required, can be provided for example.

The blocking element 3 shown in FIG. 9 to FIG. 12 comprises a cuboid-like basic body 32 with six sides. A gripping plate 31 is integrally formed on the front side of the basic body 32, the basic body 32 is connected to a rear plate 33 on a rear side which is located opposite the gripping plate 31. The rear plate 33 comprises a flat rear surface 34. A structured surface for increasing the grip or a raised marking can be provided on a front surface of the gripping plate 31. As can be seen in the top view in FIG. 10, the surfaces of the gripping plate 31 and of the rear plate 33, which face one another, carry concave or convex latching elements 35 which are operatively connected to the latching elements 28 in the guide groove 27 of the sliding element 2.

FIG. 13 and FIG. 14 show a sliding element 2 with a blocking element 3 installed therein. The blocking element 3 is guided between the spring webs of the sliding element 2 and is shown in a first release position which allows a movement of the second engagement surfaces 24 with respect to one another. The wall thickness of the rear plate 33 of the blocking element 3 corresponds to the height of the guide grooves 27, located in the spring elements 23, on the sliding element 2. The rear surface 24 of the blocking element 3 lies plane-parallel to the rear surface 29 of the carrying plate 21 of the sliding element 2. As shown in FIG. 14, the guide grooves 27 extend in the vertical direction parallel to the outer side edges of the guide strips 22, 25 from the rear surface 29 of the carrying plate 21 to a stop which is formed by the second guide strips 25 which are pulled inward at the end.

FIG. 15 shows a retaining device 10 having a carrying element 26, which is vertically adjustable therein, is able to be guided in the base plate 1 as part of the sliding element 2 and fixed by the blocking element 3.

The sliding element 2 can be displaced relative to the base plate 1. The connecting web 19, which connects the front walls 15 together in the region of a lower edge of the base plate 1, serves as a lower stop of the first guide channel 61 for the sliding element 2, reinforces the front walls 15 and serves as a surface for the marking for the fastening device 100.

FIG. 16 shows an alternative embodiment of a fastening device 100 according to the invention. Compared to the preceding realizations, the base plate 1 is wider such that the rear surface 11 comprises a larger adhesion surface. In addition, the carrying element 26 is realized as a threaded bolt. As a result of a nut (not shown), an object can consequently be fastened on the wall by means of a screw connection without a bore in the wall and the insertion of a dowel and a screw being necessary for this purpose.

Figure 17:
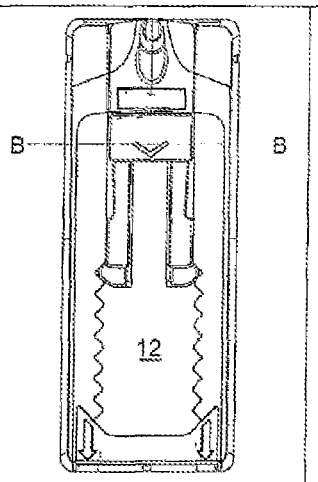
FIG. 17 shows a sectional representation of the retaining device from FIG. 13.
Figure 18:
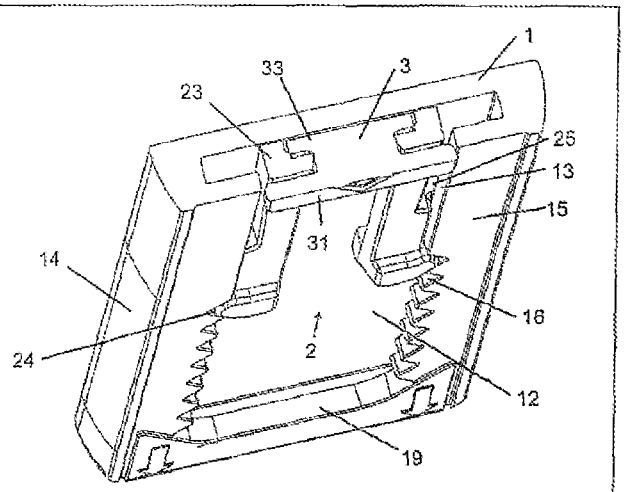
FIG. 18 shows a further sectional representation of the retaining device from FIG. 13.

FIG. 17 and FIG. 18 show a sectional view, from which the guiding of the approximately H-shaped blocking element 3 between the L-shaped profiled spring elements 23 is visible. The gripping plate 31 of the blocking element 3 is in front of the spring element 23 and in front of the front surface of the front wall 15. The guide strips 25, which are integrally formed on the ends of the spring elements 23, are guided between the front surface 12 of the base 20 and the inside surface of the front wall 15. This consequently ensures that the second engagement surfaces 24, connected thereto, are guided inside the first engagement surfaces 16. The sliding element 2 is prevented from tilting as a result of the engagement of the guide strips 25 of the sliding element 2 in the gap between the front walls 15 and the base 20. In addition, the sliding element 2 can be prevented from being able to fall forward out of the first guide channel 61 under load as the front walls 15 delimit the movement of the sliding element 2 in the direction away from the base 20.

Figure 19:
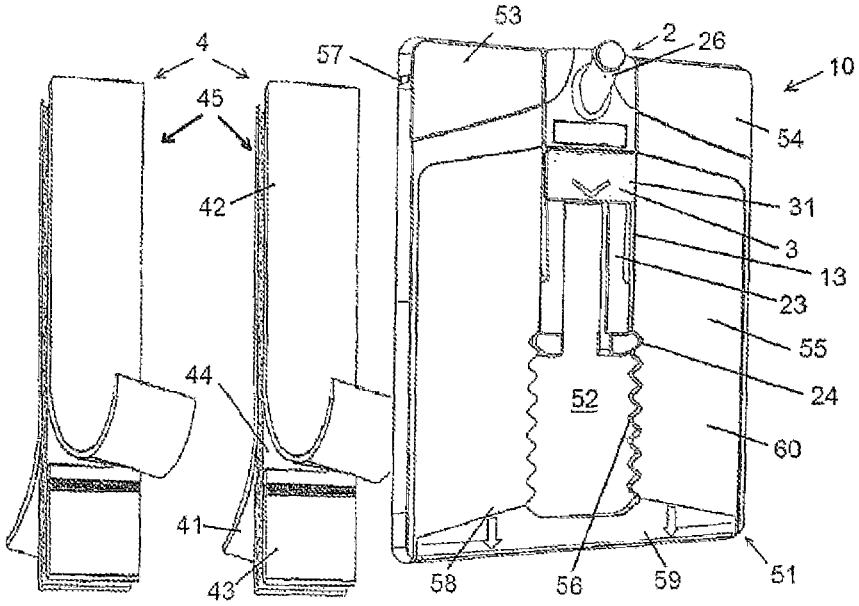
FIG. 19 shows a further embodiment of a fastening device according to the invention with a retaining device and an adhesive strip which is effective on two sides.

FIG. 19 shows a fastening device 100 which is fastenable on a wall with two adhesive strips 45 which are effective on two sides and can be pulled undone. The adhesive strips 45, which are effective on two sides, each have two sticky main surfaces 44 which are located opposite one another. Said sticky main surfaces comprise on oppositely situated end portions a region which is not provided with an adhesive and is realized as a tab 43. This can be achieved, for example, by a foil covering when the adhesive is applied. The surface area of said tabs 43, in a preferred manner, is between 2 $cm^2$ and 4 $cm^2$ in order to provide sufficient gripping surface between the tip of a thumb and an index finger. The tab should, however, not take up any more than 40% of the entire main surface 44. The two main surfaces 44 of each adhesive strip 45 are usually covered by protective foils 41, 42. For fastening the retaining body 10 on a wall, first of all the wall-side first protective foil 41 is removed from each adhesive strip 45 and the two adhesive strips 45 are bonded to the wall inside a region which corresponds to the rear surface 11 of the base plate 1. Once the second protective foil 42 has been removed, the retaining device 10 is pressed onto the adhesive strips 45. As a result of the positioning notches 17, 57 on the oppositely situated outside edges of the retaining device 10, said retaining device can be aligned to a reference line or using a spirit level. In particular when bonding on rough substrates, such as woodchip wallpaper or plastered walls, it is desirable, in view of a maximized holding performance, when the retaining device 10 is pressed several times at different positions of the front walls 15, 55 with a fingertip of a human hand. This increases the surface moistened by the adhesive surfaces between the main surfaces 44 of the adhesive strip 45 and a substrate. In order to support the pressing, the front walls 15, 55 are divided into four pressing surfaces 53, 54, 58, 60 by means of raised reinforcing ribs.

Figure 20:
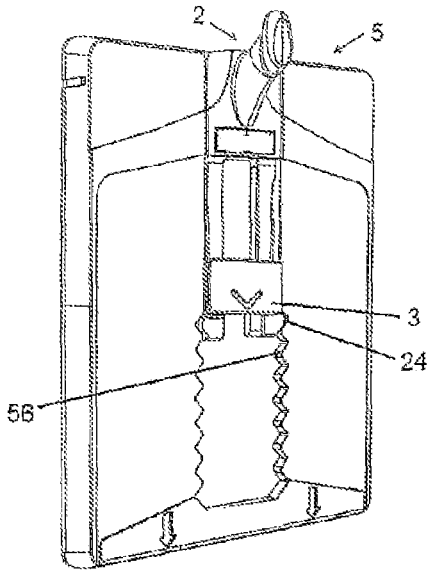
FIG. 20 shows the retaining device from FIG. 19 in the blocked position.

Once the retaining body 10 has been fastened, it is possible to adjust the height of the carrying element 26 retrospectively. To this end, the blocking element 3, guided in the sliding element 2, is pushed upward against the force of gravity and latches there in the first release position. The sliding element 2 can then be displaced in the vertical guide channel of the base plate 51. In this case, the second engagement surfaces 24, which are integrally formed at the end of the spring elements 23 of the sliding element 2, are moved inward intermittently and slide over the tooth flanks of the first engagement surfaces 16, 56. Once the desired height position of the carrying element 26 is found, the blocking element 3 is moved downward in the direction of gravity into the second blocking position, as shown in FIG. 20. The blocking element 3 is also held in said position as a result of gravity or gravitational force. In addition, it can latch in the second blocking position as a result of the latching elements 28 on the spring elements 23 of the sliding element 2 and on the blocking element 3. The blocking element 3 now prevents the spring elements 23 from deflecting inward such that the second engagement surfaces 24 on the sliding element 2 engage with the first engagement surfaces 16, 56 on the base plate 1, 51.

The retaining body 10 can also be installed in this sense on inclined walls as long as another sufficient weight acts on the blocking element 3 in the direction of the second guide channel 62. On a wall which is inclined by 45° in relation to the vertical, effort required in order to move the blocking element 3 out of the blocking position along said guide channel would be reduced by approximately 29% in a parallel second guide channel 62.

The engagement of the second engagement surfaces 24 of the sliding element 2 in the first engagement surfaces 16, 56 of the base plate 1, 51 can be reinforced by an additional clamping action. It is thus possible to design the spring elements 23 of the sliding element 2 in a V-shaped manner such that the inside surfaces of the spring elements 23 move closer to one another in the direction of the free end of the spring elements 23 and thus a displacement of the blocking element 3 downward urges the second engagement surfaces 24 into the first engagement surfaces 16, 56. In this case, the width of the blocking element 3 shown in FIG. 11 on the basic body 32 is to be chosen to be greater than the maximum distance between the inside surfaces of the spring elements 23 which face one another. As an alternative to this, the first engagement surfaces 16, 56 or the second engagement surfaces 24 can be realized so as to be elastically compressible.

The displacement of the blocking element 3 and the displacement of the sliding element 2 are effected by a force which is exerted by a human hand. In this case, one objective is that the force vectors that are active in this case do not result in additional tensile normal stresses in the adhesion of the retaining device 10 as this can weaken the adhesion as a result of a peeling load. Specifically, the sliding element 2 being locked or unlocked by a tensile force would, in particular, be disadvantageous. A torsional force, which would occur when using an eccentric blocking element 3, is also unfavorable. Consequently, all displaceable elements are designed such that they can only be displaced and moved in planes which lie parallel to the rear wall 11 of the retaining device 10, that is to say parallel to the adhesion surface, and do not effect torsional forces during displacement. In this case, when the moving parts, that is to say of the sliding element 2 and/or of the blocking element 3, are displaced by the hand of a user, a translatory movement which also runs parallel to the adhesive surface is carried out.

Only force vectors which load the adhesion normally to the adhesive surface with pressure in a non-critical manner or run parallel to the adhesive surface without pronounced stress peaks are consequently necessary for displacing the blocking element 3 or the sliding element 2.

Figure 21:
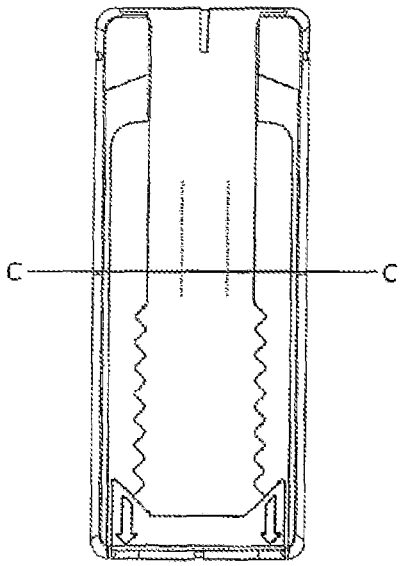
FIG. 21 shows a sectional diagram to illustrate the guide channels.

As shown in FIG. 21 and FIG. 22, the second guide channel 62 for the blocking element 3 lies inside the first guide channel 61 for the sliding element 2. A space-saving design with a low installation height is, consequently, possible.

Figure 25:
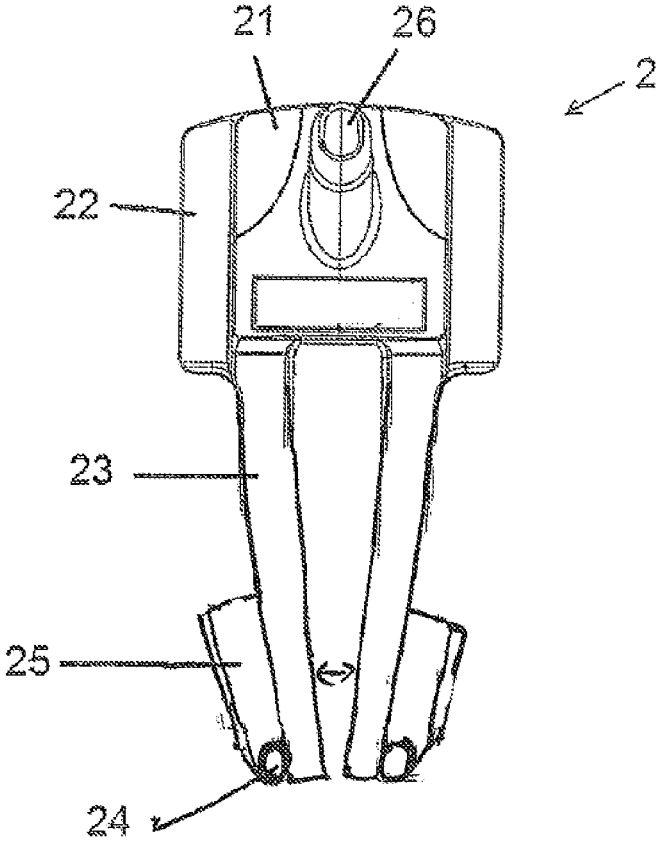
FIG. 25 shows a schematic image of the front view of a further sliding element.

FIG. 25 shows a further sliding element 2 of a fastening device 100 according to the invention. In this case, the two spring elements 23 form a second guide channel 62 which tapers conically in the direction of the free ends of the sliding element 2 in the non-loaded state, i.e. in the release position. As a result of displacing the blocking element 3 in the direction of the free ends of the spring elements 23, the spring elements 23 are each deformed in the outward direction such that the spring elements 23 are aligned in a largely parallel manner at least in the lower end position of the blocking element 3, that is to say in the blocking position.

A production material for the retaining body of a fastening device 100 according to the invention has to be selected with consideration to a plurality of factors and to the site of application. In particular, the production material should be compatible with the adhesive composition of the adhesive used for installation, in particular of the adhesive strip 45 which is effective on two sides, and should adhere thereto in a reliable manner. In moist surroundings, the water absorbency and water resistance of the material can be a limiting factor. The material used should also withstand further environmental influences, such as UV radiation or ozone and exhaust gas pollution, for a suitable time without its material characteristics deteriorating in a substantial manner.

A material which is compatible with adhesives strips which are based on styrene compositions with industry-standard adhesive resins and further additives is polystyrene. The disadvantageous tendency to stress cracking can be reduced by using special qualities, such as high impact polystyrene (HIPS), such as, for example, polystyrene 432B. As an alternative to this, it is possible to use (glass) fiber-reinforced polystyrene grades, both syndiotactic polystyrene and normal polystyrene being able to be used. In a preferred manner, the (glass) fiber proportion is between 10% and 50%, in a particularly preferred manner between 20% and 40%, of the filler content such as, for example, in the case of the syndiotactic type Schulatec® PS-S-GF 40. Determination of the filler content of reinforcing fibers can be found in DIN EN ISO 11667. Styrene acrylonitrile (SAN), acrylonitrile-styrene-acrylate (ASA), acrylonitrile-butadiene-styrene (ABS) and (glass) fiber-reinforced acrylonitrile-styrene-acrylate are also suitable as production materials. As an alternative to this, carbon fiber-reinforced plastics materials, in particular carbon fiber-reinforced epoxy resins or carbon fiber-reinforced polyether ether ketone (PEEK), can also be used. In addition, crystalline or amorphous metals, steel, aluminum or titanium alloys, which can be used as production material for the components 1, 2, 3 of the retaining body 10, are suitable for special applications.

According to a first embodiment, the invention relates to a fastening device (100) having at least one positionable carrying element (26), including:

- a base plate (1) with a largely flat rear surface (11) and a front surface (12) which is situated opposite the rear surface (11), wherein
- a first guide channel (61) is realized on the front surface (12), wherein the guide channel (61) is delimited by side walls (14), wherein engagement surfaces (16) are realized at least in portions on at least one of the side walls (14), wherein
- a sliding element (2), which is displaceable along the guide channel (61), is arranged in the guide channel (61), wherein
- the carrying element (26) is arranged on the sliding element (2), and wherein
- two spring elements (23), which can engage with the engagement surfaces (16) of the guide channel (61) in a blocking position, are realized on the sliding element (2), characterized in that
- a movable blocking element (3), which fixes the spring elements (23) at least in the blocking position, is provided on the sliding element (2).

According to a second embodiment, the invention relates to a fastening device (100) as claimed in the first embodiment, characterized in that in a release position of the blocking element (3), the spring elements (23) are not engaged with the engagement surfaces (16), wherein the blocking element (3) fixes the spring elements (23) also in the release position.

According to a third embodiment, the invention relates to a fastening device (100) as claimed in the first or the second embodiment, characterized in that the two spring elements (23) realize a second guide duct (62), wherein the blocking element (3) is reversibly displaceable along the second guide duct (62).

According to a fourth embodiment, the invention relates to a fastening device (100) as claimed in the third embodiment, characterized in that the blocking element (3) in a first release position in the second guide duct (62) enables a displacement of the sliding element (2) along the first guide duct (61) and the blocking element (3) in a second blocking position in the second guide duct (62) suppresses a displacement of the sliding element (2) along the first guide duct (61).

According to a fifth embodiment, the invention relates to a fastening device (100) as claimed in the fourth embodiment, characterized in that a displacement of the blocking element (3) from the second blocking position into the first release position is effected against the force of gravity.

According to a sixth embodiment, the invention relates to a fastening device (100) as claimed in the third to fifth embodiment, characterized in that the second guide duct (62) runs completely inside the first guide duct (61).

According to a seventh embodiment, the invention relates to a fastening device (100) as claimed in the first to sixth embodiment, characterized in that the first guide duct (61) is angled at a maximum of 45° to the direction of gravity and in a preferred manner runs parallel to the direction of gravity.

According to an eighth embodiment, the invention relates to a fastening device (100) as claimed in the first to seventh embodiment, characterized in that the engagement surfaces (16) are realized on both sides in the side walls (14) of the first guide duct (61).

According to a ninth embodiment, the invention relates to a fastening device (100) as claimed in the first to eighth embodiment, characterized in that the first guide duct (61) is closed or closable by a connecting web (19) at one end, in a preferred manner at the lower end in the direction of the gravity.

According to a tenth embodiment, the invention relates to a fastening device (100) as claimed in the first to ninth embodiment, characterized in that guide grooves (27) and latching elements (28) for the blocking element (3) are provided on the sliding element (2).

According to an eleventh embodiment, the invention relates to a fastening device (100) as claimed in the first to tenth embodiment, characterized in that the sliding element (2) comprises a carrying plate (21) with a horizontal groove which runs perpendicular to the first guide duct (61), wherein the carrying element (26) is displaceably mounted in the horizontally extending groove.

According to a twelfth embodiment, the invention relates to a fastening device (100) as claimed in the first to eleventh embodiment, characterized in that on the free ends of the spring elements (23), the sliding element (2) comprises second engagement surfaces (24) which can be operatively connected to the first engagement surfaces (16), in particular can latch in the first engagement surfaces (16).

According to a thirteenth embodiment, the invention relates to a fastening device (100) as claimed in the first to twelfth embodiment, characterized in that guide strips (22, 25), by way of which the sliding element (2) is guided displaceably in the base plate (1), are realized on the spring elements (23).

According to a fourteenth embodiment, the invention relates to a fastening device (100) as claimed in the thirteenth embodiment, characterized in that the guide strips (22, 25) are guided between a base (20), the base plate (1) and the front walls (15) of the base plate (1).

According to a fifteenth embodiment, the invention relates to a fastening device (100) as claimed in the first to fourteenth embodiment, characterized in that pressing surfaces (53, 54, 58, 60) are provided on the base plate (1) for applying an installing force when bonding the base plate (1) to a surface.

According to a sixteenth embodiment, the invention relates to a fastening device (100) as claimed in the first to fifteenth embodiment, characterized in that the fastening device (100) includes fastening means (4), in particular an adhesive strip (45) which is effective on two sides, for fixing on a surface, in particular of a vertical wall.

According to a seventeenth embodiment, the invention relates to a fastening device (100) as claimed in the sixteenth embodiment, characterized in that the fastening means (4), in particular the adhesive strip (45) which is effective on two sides, are detachable from the surface in a residue-free and damage-free manner.

According to an eighteenth embodiment, the invention relates to a fastening device (100) as claimed in the first to seventeenth embodiment, characterized in that the second guide duct (62) tapers conically in the release position in the direction of the free ends of the spring elements (23).

LIST OF REFERENCES

1 Base plate
2 Sliding element
3 Blocking element
4 Fastening means
11 Rear surface
12 Front surface
14 Side wall
15 Front wall
16 First engagement surface
19 Connecting web
20 Base
21 Carrying plate
22 Guide strip
23 Spring element
24 Second engagement surface
25 Guide strip
26 Carrying element
27 Guide groove
28 Latching element
45 Adhesive strip
53 Pressing surface
54 Pressing surface
58 Pressing surface
60 Pressing surface
61 First guide channel
62 Second guide channel
100 Fastening device

The invention claimed is:

1. A fastening device having at least one positionable carrying element, comprising:

a base plate with a largely flat rear surface and a front surface which is situated opposite the rear surface, wherein a first guide channel is realized on the front surface, wherein the guide channel is delimited by side walls, wherein engagement surfaces are realized at least in portions on at least one of the side walls, wherein a sliding element, which is displaceable along the guide channel, is arranged in the guide channel, wherein the carrying element is arranged on the sliding element, and wherein two spring elements, which can engage with the engagement surfaces of the guide channel in a blocking position, are realized on the sliding element, wherein a movable blocking element, which fixes the spring elements at least in the blocking position, is provided on the sliding element, wherein the two spring elements realize a second guide channel, wherein the blocking element is reversibly displaceable along the second guide channel, wherein the blocking element in a first release position in the second guide channel enables a displacement of the sliding element along the first guide channel and the blocking element in a second blocking position in the second guide channel suppresses a displacement of the sliding element along the first guide channel, and wherein a displacement of the blocking element from the second blocking position into the first release position is effected against the force of gravity.

2. The fastening device as claimed in claim 1, wherein with the blocking element in a release position, the spring elements are not engaged with the engagement surfaces, wherein the blocking element fixes the spring elements also in the release position.

3. The fastening device as claimed in claim 1, wherein the second guide channel runs completely inside the first guide channel.

4. The fastening device as claimed in claim 1, wherein the first guide channel is angled at a maximum of 45° to the direction of gravity and optionally runs parallel to the direction of gravity.

5. The fastening device as claimed in claim 1, wherein the engagement surfaces are realized on both sides in the side walls of the first guide channel.

6. The fastening device as claimed in claim 1, wherein the first guide channel is closed or closable by a connecting web at one end, optionally at a lower end in the direction of the gravity.

7. The fastening device as claimed in claim 1, wherein guide grooves and latching elements for the blocking element are provided on the sliding element.

8. The fastening device as claimed in claim 1, wherein the sliding element comprises a carrying plate with a horizontal groove which runs perpendicular to the first guide channel, wherein the carrying element is displaceably mounted in the horizontally extending groove.

9. The fastening device as claimed in claim 1, wherein on free ends of the spring elements, the sliding element comprises two engagement surfaces which can be operatively connected to the first engagement surfaces, optionally can latch in the first engagement surfaces.

10. The fastening device as claimed in claim 1, wherein guide strips, by way of which the sliding element is guided displaceably in the base plate, are realized on the spring elements.

11. The fastening device as claimed in claim 10, wherein the guide strips are guided between a base, the base plate and front walls of the base plate.

12. The fastening device as claimed in claim 1, wherein pressing surfaces are provided on the base plate for applying an installing force when bonding the base plate to a surface.

13. The fastening device as claimed in claim 1, wherein the fastening device includes fastening means, optionally an adhesive strip which is effective on two sides, for fixing on a surface, optionally on a vertical wall.

14. The fastening device as claimed in claim 13, wherein the fastening means, optionally the adhesive strip which is effective on two sides, are detachable from the surface in a residue-free and damage-free manner.

15. The fastening device as claimed in claim 1, wherein the second guide channel tapers conically in the release position in the direction of the free ends of the spring elements.

* * * * *